US005381561A

United States Patent [19]

Carson, III

[11] Patent Number: 5,381,561

[45] Date of Patent: Jan. 17, 1995

[54] BIFLUSH VALVE SYSTEM FOR CONSERVING WATER ESPECIALLY FOR TANK-TYPE TOILETS

[76] Inventor: James H. Carson, III, 7981 Tickneck Rd., Pasadena, Md. 21122-6312

[21] Appl. No.: 78,458

[22] Filed: Jun. 16, 1993

[51] Int. Cl.[6] ..... E03D 1/14

[52] U.S. Cl. ..... 4/326

[58] Field of Search ..... 4/324, 325, 326, 327

[56] References Cited

U.S. PATENT DOCUMENTS

| | | | |
|---|---|---|---|
| 3,375,531 | 4/1968 | Lake | 4/326 |
| 3,768,103 | 10/1973 | Robinson | 4/326 |
| 3,795,016 | 3/1974 | Eastman | 4/326 |
| 4,056,856 | 11/1977 | Reid et al. | 4/326 |
| 4,096,591 | 6/1978 | Awis | 4/326 |
| 4,110,850 | 9/1978 | Tedei | 4/326 |
| 4,120,055 | 10/1978 | Mormile | 4/324 |
| 4,122,564 | 10/1978 | Addicks et al. | 4/326 |
| 4,144,600 | 3/1979 | Mayes | 4/324 |
| 4,172,299 | 10/1979 | del Pozo | 4/326 |
| 4,173,801 | 11/1979 | Bresnyan | 4/326 |
| 4,504,984 | 3/1985 | Burns | 4/326 |
| 4,561,131 | 12/1985 | David | 4/326 |
| 5,005,225 | 4/1991 | Pasquin | 4/326 |
| 5,033,129 | 7/1991 | Gajewski | 4/326 |
| 5,111,537 | 5/1992 | Zaruba | 4/324 |
| 5,121,510 | 6/1992 | Ricalde Medina | 4/326 |
| 5,175,893 | 1/1993 | Navarrete | 4/326 |
| 5,261,129 | 11/1993 | Roy | 4/326 |

*Primary Examiner*—Robert M. Fetsuga
*Attorney, Agent, or Firm*—Leonard Bloom

[57] ABSTRACT

A flush system for use in a toilet has a hollow body with an upper valve port and a lower valve port on which are seated an upper valve and a lower valve. The respective valves are attached to a first connecting rod and a second connecting rod. The connecting rods are attached to respective handles which are pivoted to unseat the respective valves. Unseating the upper valve produces a full flush of the toilet using a smaller regulated amount of water and unseating the lower valve produces a full flush of the toilet using a larger regulated amount of water. The handles are collocated on the outside of a water storage tank and the stems of the handles are coaxial. A bend is formed on the second connecting rod such that when the first handle is pivoted, the bend on the second connecting rod engages the first connecting rod and both the upper valve and the lower valve are unseated by the movement of the first handle. The bend portion of the second connecting rod may be broken-away to provide independent control of the unseating of the upper valve and lower valve by the respective second handle and first handle.

7 Claims, 6 Drawing Sheets

BIFLUSH VALVE SYSTEM FOR CONSERVING WATER ESPECIALLY FOR TANK-TYPE TOILETS

FIELD OF THE INVENTION

The present invention relates to a flush valve system for use with a tank-type toilet, and more particularly, to a system having two valves which are separately controlled by two collocated handles,each handle connected to a respective valve by a respective connecting rod.

BACKGROUND OF THE INVENTION

Flushing of a tank-type toilet requires approximately five (5) gallons of water. This is wasteful of water and is especially of concern when water shortage, water purification and sewage treatment problems exist in many localities. The applicant is aware of the following U.S. patents which have recognized these problems and have proposed devices to reduce the problem.

| Inventor(s) | U.S. Pat. No. |
|---|---|
| Lake | 3,375,531 |
| Robinson | 3,768,103 |
| Addicks et al | 4,122,564 |
| Mayes | 4,144,600 |
| del Pozo | 4,172,299 |
| Bresnyan | 4,173,801 |
| Burns | 4,504,984 |
| David | 4,561,131 |
| Pasquin | 5,005,225 |
| Gajewski | 5,033,129 |
| Zaruba | 5,111,537 |
| Medina | 5,121,510 |
| Navarrete | 5,175,893. |

However, for a variety of reasons the devices disclosed in these patents have not been generally accepted despite the longstanding need. Some of the devices require specially made parts. Others cannot be used with the standard toilet tank. Still others require the user to acquire a special technique for turning or controlling the handle movement.

Thus, there is a need for a flush valve system which can be easily controlled in a standard tank-type toilet, which requires no unusual use techniques and which conserves water.

SUMMARY OF THE INVENTION

Accordingly, it is a primary object of the present invention to provide a flush valve system for use in a standard tank-type toilet which has two valves and two collocated handles to permit selective partial or total water usage, for complete flushing of the toilet.

It is another object of the invention to provide a flush valve system for use in a tank-type toilet which can be installed in an existing tank-type toilet and will permit conservation of water.

In accordance with the teachings of the present invention, there is disclosed herein a flush valve system for use in a toilet having a water storage tank. The water storage tank has a bottom, an inside, an outside and a wall therebetween. The flush valve system includes a hollow body mounted inside the tank on the bottom thereof. The body has an upper valve port, a lower valve port and an overflow vent therein. An upper valve and a lower valve are provided. Means are provided for seating and unseating the upper valve on the upper valve port. Also, means are provided for seating and unseating the lower valve on the lower valve port. A first connecting rod is provided which has a first end and an opposite second end. The first end is connected to the upper valve by a flexible connector. A second connecting rod is provided which has a first end and an opposite second end. The first end of the second rod is connected to the lower valve by a flexible connector. A first handle is pivotally mounted on the outside of the storage tank. The first handle has a stem extending to the inside of the storage tank through the wall of the tank. The stem of the first handle is connected to the second end of the second connecting rod. In this manner, when the first handle is pivoted downwardly, the first end of the second connecting rod is elevated and the lower valve is unseated from the lower valve port such that the toilet is fully flushed using a larger regulated amount of water. A second collocated handle is pivotally mounted on the outside of the storage tank. The second handle has a stem extending to the inside of the storage tank through the wall of the tank. The stem of the second handle is coaxial with the stem of the first handle. The stem of the second handle is connected to the second end of the first connecting rod. In this manner when the second handle is pivoted downwardly, the first end of the first connecting rod is elevated and the upper valve is unseated from the upper valve port such that the toilet is fully flushed using a smaller regulated amount of water. The first connecting rod is disposed in a first horizontal plane. The second connecting rod is disposed in a second and lower horizontal plane. The first end of the second connecting rod has a bend formed therein, the end extending under the first connecting rod. When the first handle is pivoted downwardly, and the first end of the second rod is elevated, the bend on the second connecting rod engages the first connecting rod and elevates the first connecting rod. In this manner, the lower valve and the upper valve are both unseated and the toilet is fully flushed These and other objects of the present invention will become apparent from a reading of the following specification, taken in conjunction with the enclosed drawings.

DESCRIPTION OF THE PREFERRED EMBODIMENTS

Figure 1:
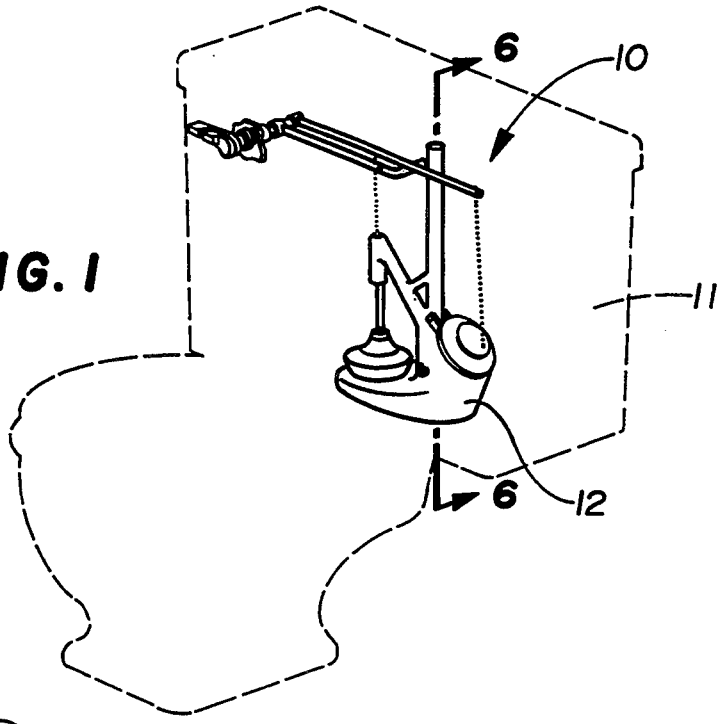
FIG. 1 is a perspective view of the toilet showing the flush valve system of the present invention mounted in the water storage tank.
Figure 2:
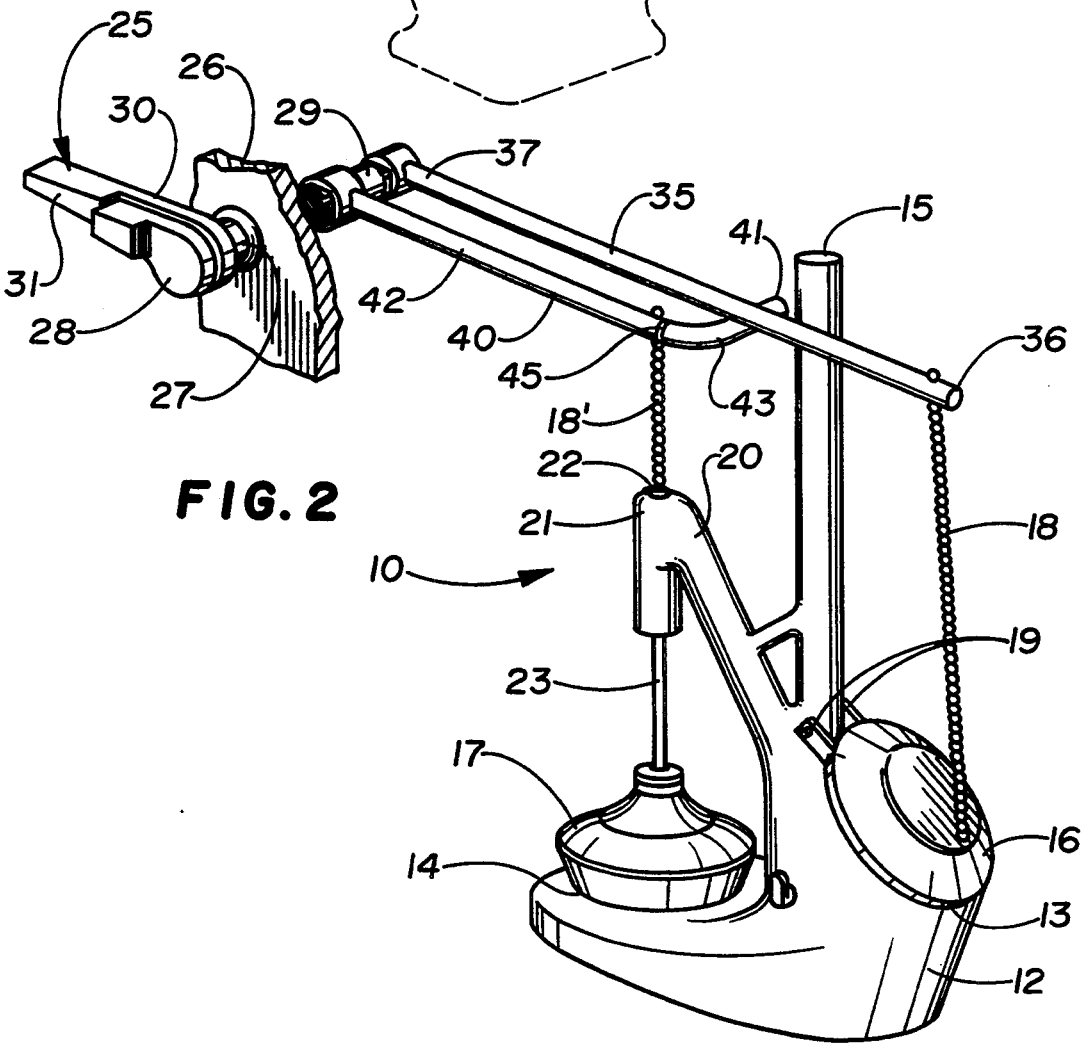
FIG. 2 is a perspective view of the flush valve system of the present invention showing the body with the valves seated in the valve ports and the valves connected to the handles.
Figure 3:
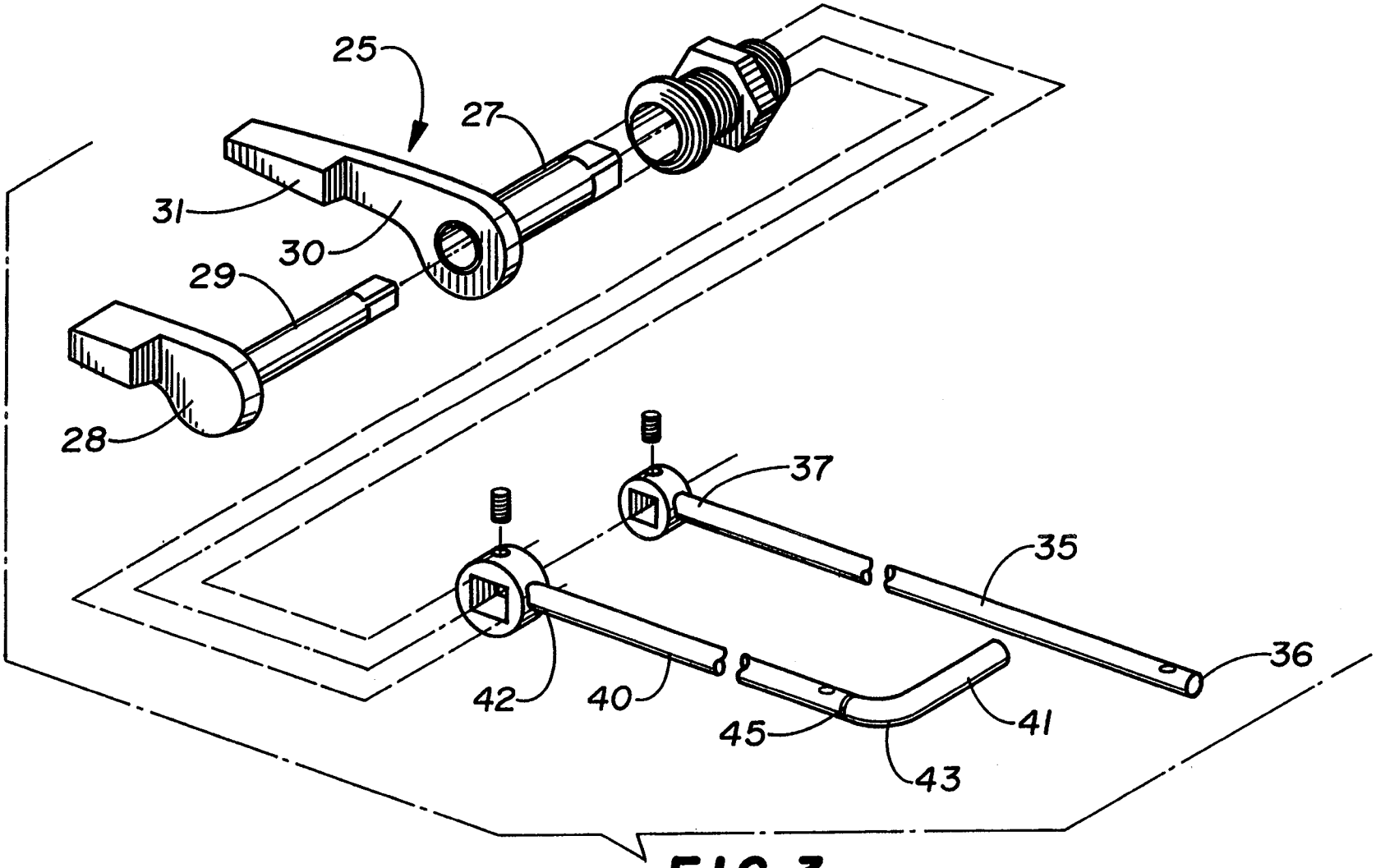
FIG. 3 is an exploded view of the handles of the system of the present invention.
Figure 5:
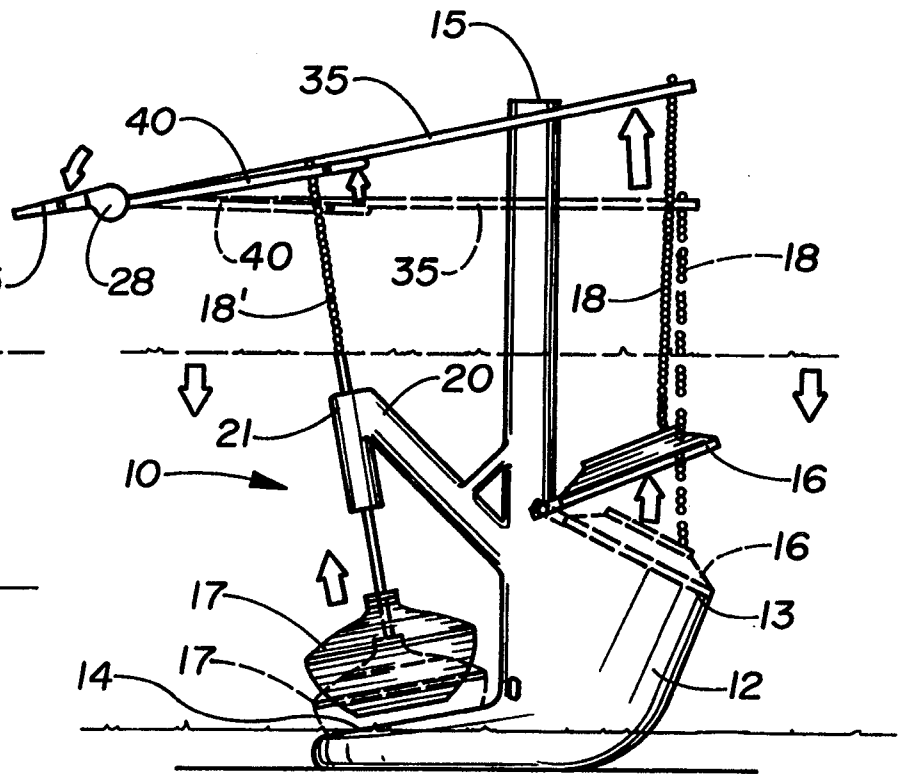
FIG. 5 is a side elevational view showing activation of the first handle to fully flush the toilet using a larger regulated amount of water.
Figure 4:
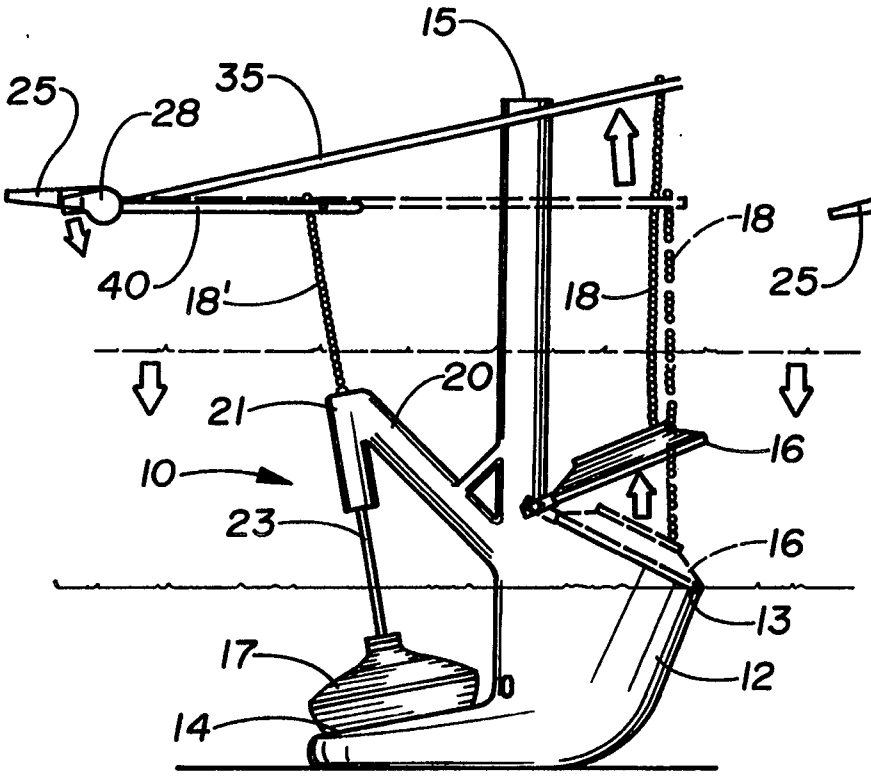
FIG. 4 is a side elevational view showing activation of the second handle to fully flush the toilet using a smaller regulated amount of water.
Figure 6:
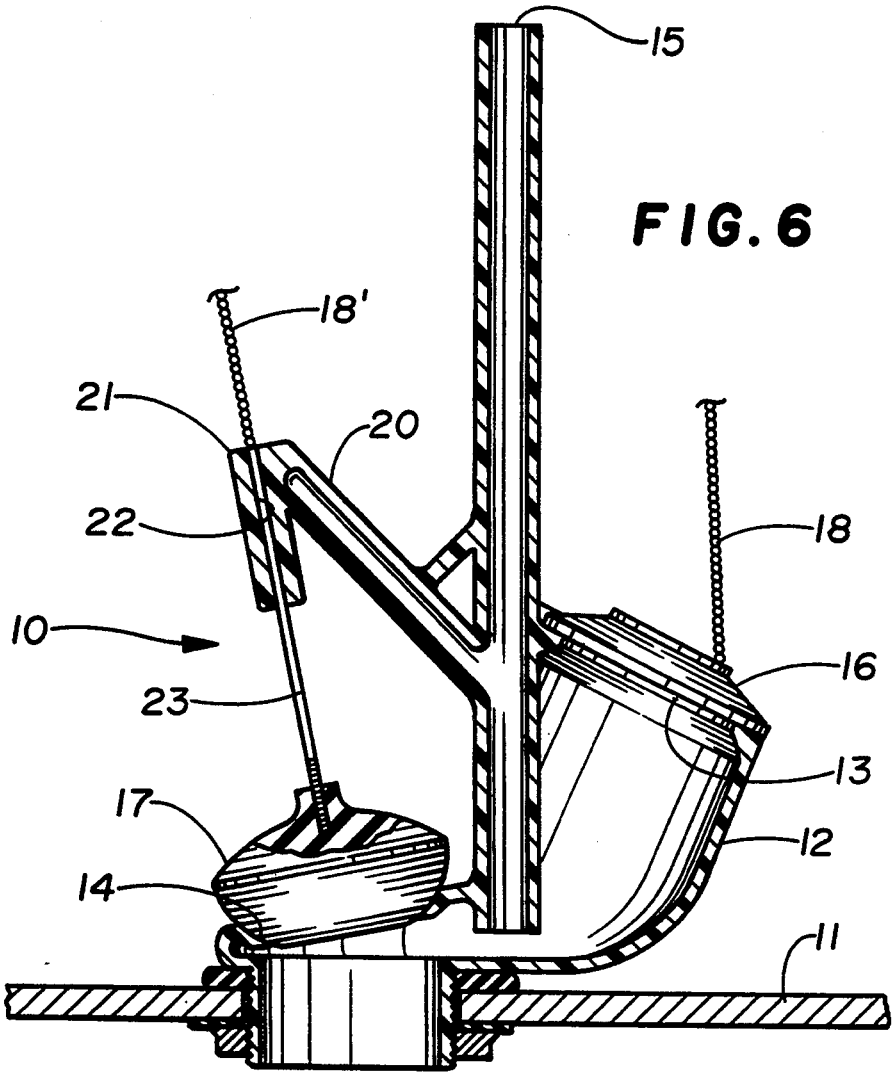
FIG. 6 is a cross-sectional view across the lines 6—6 of FIG. 1.
Figure 7:
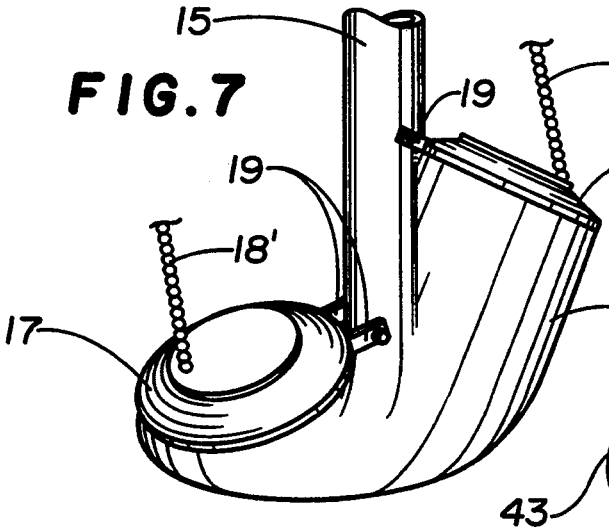
FIG. 7 is a partial perspective view of an alternate embodiment of flush valve system showing a flapper type lower valve.
Figure 8:
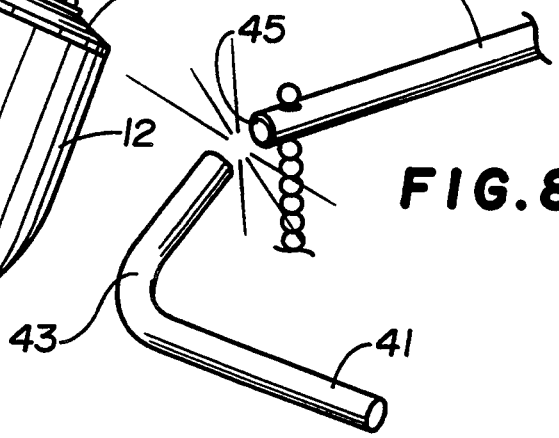
FIG. 8 is a perspective view of the second connecting rod showing the break-away means near the bend in the rod.

Referring now to FIG. 1, the flush valve system 10 of the present invention is shown mounted in the bottom of the water storage tank 11 of the toilet. The hollow body 12 of the system 10 is mounted in an opening in the bottom of the storage tank 11 so that water exiting the hollow body 12 may flow into the bowl of the toilet to flush the toilet. The hollow body 12 has an upper valve port 13, a lower valve port 14 and an overflow vent 15 formed in the hollow body 12, all of which are in communication with one another. The overflow vent 15 is open at the top to communicate with the interior of the water storage tank 11. It is preferred that the valve ports 13, 14 be located on opposite sides of the hollow body 12.

An upper valve 16 is disposed on the upper valve port 13 and a lower valve 17 is disposed on the lower valve port 14 (FIGS. 2–6). Means are provided for seating and unseating the respective valves 16, 17 on the respective valve ports 13, 14. The valves 16, 17 may be flapper type valves which have a circular flange type surface which has a diameter larger than the diameter of the valve port 13, 14 and a depending conical bulb which is received in the hollow body 12 through the valve port. A flexible connector 18, 18' is connected to the top of the valve 16, 17 to enable the valve 16, 17 to be lifted so that the valve is unseated from the valve port 13, 14. The valve 16, 17 further has a pair of spaced-apart arms 19 formed on the flange of the valve 16, 17 and extending to the body 12. The arms 19 are pivotally connected to the body 12 so that the valve 16, 17 may be easily seated and unseated by pivoting about the connection between the arms 19 and the body 12. The valves are normally seated and are unseated to flush the toilet as will be described.

The body 12 may have a support arm 20 extending outwardly from the body 12. The end 21 of the support arm 20 has an opening 22 formed therein such that the opening 22 is disposed above the respective valve/valve port. Preferably, the support arm 20 is disposed above the lower valve port 14 in order to maintain the overall height of the body 12 to a size to be installed in the water storage tank 11. A vertical rod 23 is slidably received in the opening 22 in the support arm 20. The first end of the rod 23 is connected to the valve 17 and the second end of the rod is connected to the second connecting rod as will be described.

A first handle 25 is pivotally mounted on the outside of the wall 26 of the water storage tank 11. The first handle 25 has a stem 27 which extends to the inside of the storage tank 11 through an existing opening in the wall 26. A second handle 28 is collocated with the first handle 25 on the outside of the storage tank 11 and is pivotally mounted thereon. The second handle 28 has a stem 29 which extends to the inside of the storage tank 11 and extends through the opening in the wall 26. The stem 29 of the second handle 28 is coaxial with the stem 27 of the first handle.

The first handle 25 preferably has a flat body portion 30 and a leg portion 31. The leg portion 31 extends outwardly at approximately 90° from the body portion 30 and outwardly from the wall 26 of the storage tank 11. The stem 27 is connected to the body portion 30 of the first handle.

The second handle 28 is disposed adjacent to the flat body portion 30 of the first handle and adjacent to the extending leg 31 of the first handle 25. The stem 29 of the second handle 28 is coaxial with the stem 27 of the first handle 25. Preferably, the stem 27 of the first handle 25 is hollow and the stem 29 of the second handle 28 is received therein. In this manner the second handle 28 is nested within the first handle 25 to be easily accessible and to be aesthetically pleasing. Each handle 25, 28 may be pivotally moved independently of the other handle.

Alternately, the first handle 25 is disposed adjacent to the outside of the wall 26 of the storage tank 11 and the second handle 28 is disposed adjacent to the first handle 25 such that the first handle 25 is between the wall 26 and the second handle 28. In the alternate disposition, the handles are aligned sequentially rather than in a nesting disposition. The handles 25, 28 may be pivotally moved independently of each other.

In either embodiment, both handles 25, 28 are pivotally moved in the same counterclockwise direction. The handles 25, 28 may be made of different colors, if desired, to better enable a user to identify the control for the full and larger regulated amount of water for the flush and the partial and smaller regulated amount of water for the flush.

A second end 37 of a first connecting rod 35 is connected to the stem 29 of the second handle 28. The first opposite end 36 of first connecting rod 35 is connected to the upper valve 16, preferably through a flexible connector 18 such as a chain or elastomeric line. Thus when the second handle 28 is pivoted downwardly, the second end 37 of the first connecting rod 35 is pivoted and first end 36 of the first connecting rod 35 is elevated. The upper valve 16 is thereby also elevated and the upper valve 16 is unseated from the upper valve port 13. Water is permitted to flow through the upper valve port 13. Since only the water in the storage tank 11 above the level of upper valve port 13 will empty through the opened valve, a partial regulated amount of water to flush of the toilet is produced.

A second end 42 of a second connecting rod 40 is connected to the stem 27 on the first handle 25. The second connecting rod 40 and the first connecting rod 35 are each disposed in a separate horizontal plane inside the storage tank 11. The second connecting rod 40 is in a lower plane than the first connecting rod 35. Near the first opposite end 41 of the second connecting rod 40, a connection is made with the lower valve 17. Preferably, a flexible connector 18' such as a chain or an elastomeric line is connected near the first end 41 of the rod 40 and depends directly to a flapper type lower valve 17. However, when the lower valve is a conical bulb with a vertical rod 23 extending upwardly through the opening 22 in the support arm 20 as discussed above, the flexible connector 18' is attached to the upper end of the vertical rod 23.

The first end 41 of the second connecting rod 40 further has a bend formed thereon. The bend 43 is oriented toward the interior of the storage tank 11 and extends under the first connecting rod 35. When the first handle 25 is pivoted downwardly, the second end of the 42 of the second connecting rod 40 is pivoted in the horizontal plane and the first end 41 of the second connecting rod 40 is elevated above the horizontal plane. The lower valve 17 is thereby also elevated and the lower valve 17 is unseated from the lower valve port 14. Simultaneously, the bend 43 in the first end 41 of the second connecting rod 40 engages the underside of the first connecting rod 35 and elevates the first end 36 of the first connecting rod 35. This causes the upper valve 16 to be unseated from the upper valve port 13 at the same time as the lower valve 17 is unseated. Due to both valves being unseated, the water flows very rapidly from the water storage tank 11 into the toilet and all the water above the level of the lower valve port 17 is emptied into the toilet to produce a full flush. Also, the upper valve 16 closes before the lower valve 17 closes.

The second connecting rod 40 has a break-away means 45 formed thereon near the bend 43 in the rod 40 and between the bend 43 and the second end 42 of the second connecting rod 40. The break-away means 45 may be a ridge formed in the rod 40, a hole in the rod 40 or a plurality of small holes or indentations in the rod 40 which permit the breaking of the second connecting rod 40 at the break-away means 45. This break-away means 45 facilitates removal of the first end 41 of the second connecting rod 40 including the bend 43. When the bend portion 43 is removed, the second connecting rod 40 is no longer able to engage the first connecting rod 35 and pivotal movement of the first handle 25 produces unseating of only the lower valve 17. In this manner, pivotal movement of the first handle 25 does not unseat the upper valve 16 and the unseating of the upper valve 16 is controlled by only the second handle 28. The first handle 25 and the second handle 28 independently produce unseating of the lower valve 17 and the upper valve 16 respectively.

The present invention provides an economical system for conserving water. The partial regulated amount of water flush system uses approximately one (1) to two (2) gallons of water and the full regulated amount of water flush system uses approximately three (3) gallons of water as compared to the traditional system which requires approximately three and one-half (3½) to five (5) gallons of water. The present invention is usable in new installations and can be retrofit into existing installations. The present invention is user friendly due to the collocation of the two handles, the ease of identifying each handle and the pivoting of the handles in the same direction. The user continues to operate the toilet in the manner in which a standard toilet operates.

Figure 9:
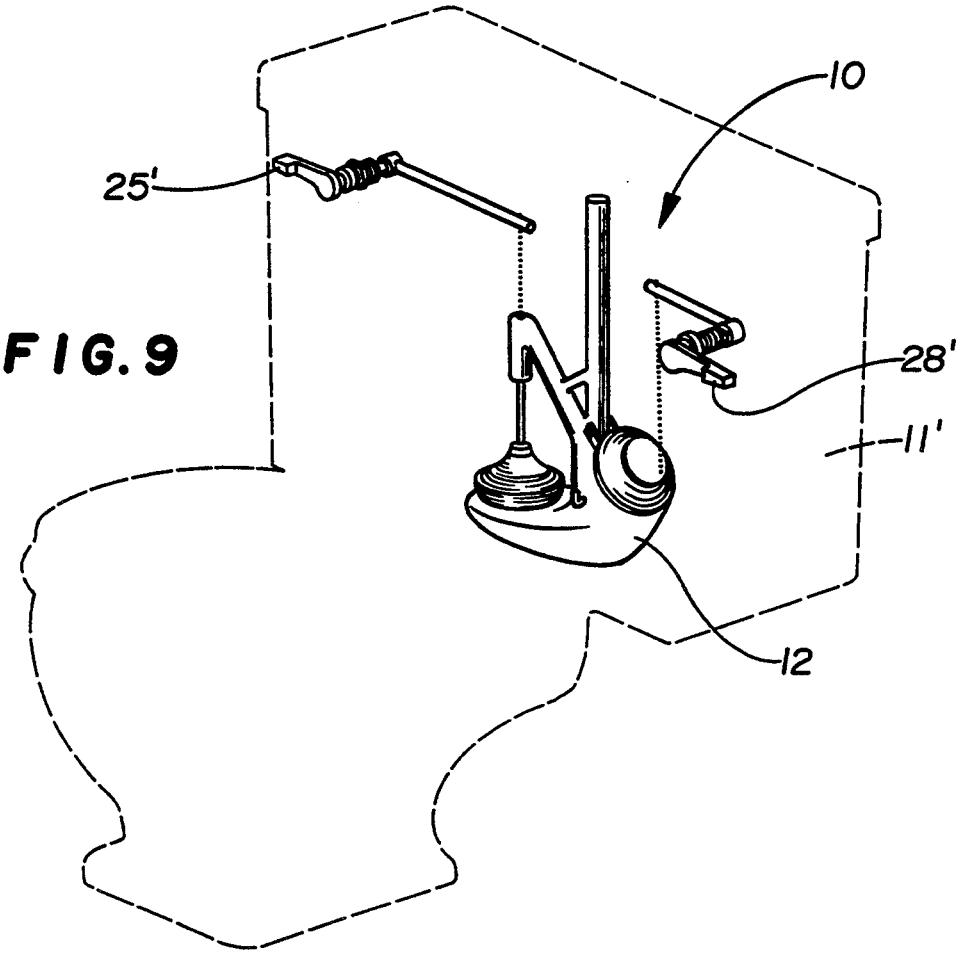
FIG. 9 is a perspective view of the toilet showing another embodiment of the present invention in which the handles are separated and disposed on opposite sides of the front of the water storage tank.
Figure 11:
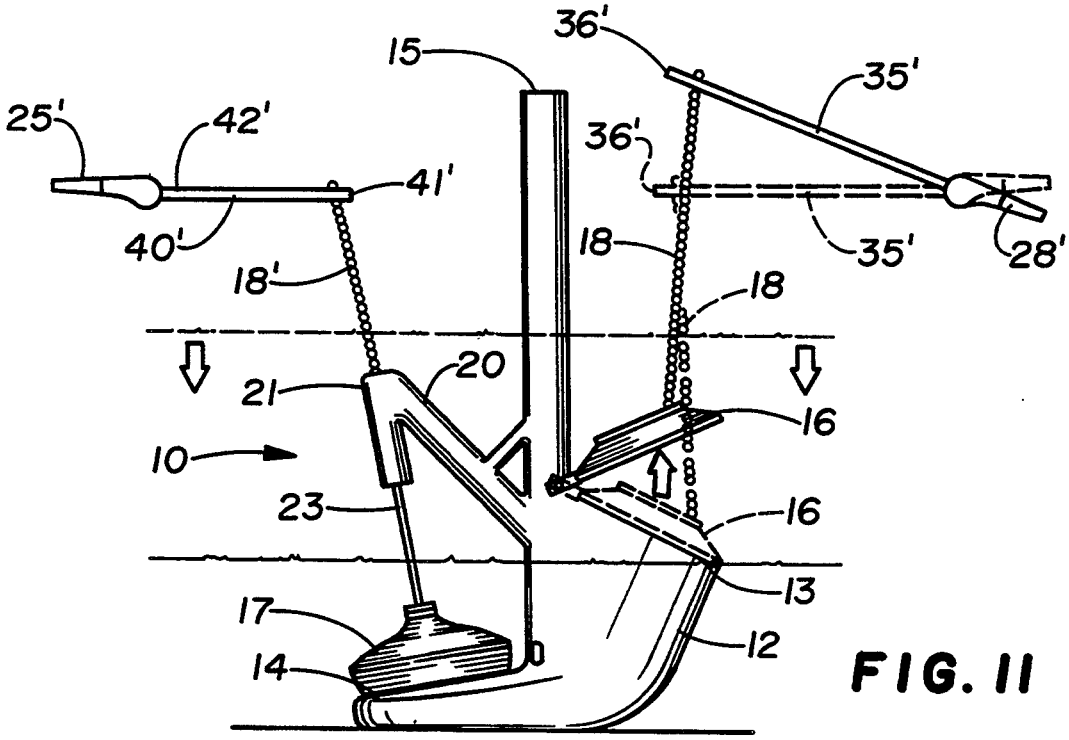
FIG. 11 is a side elevational view of the embodiment of FIG. 9 showing activation of the second handle to fully flush the toilet using a smaller regulated amount of water.
Figure 10:
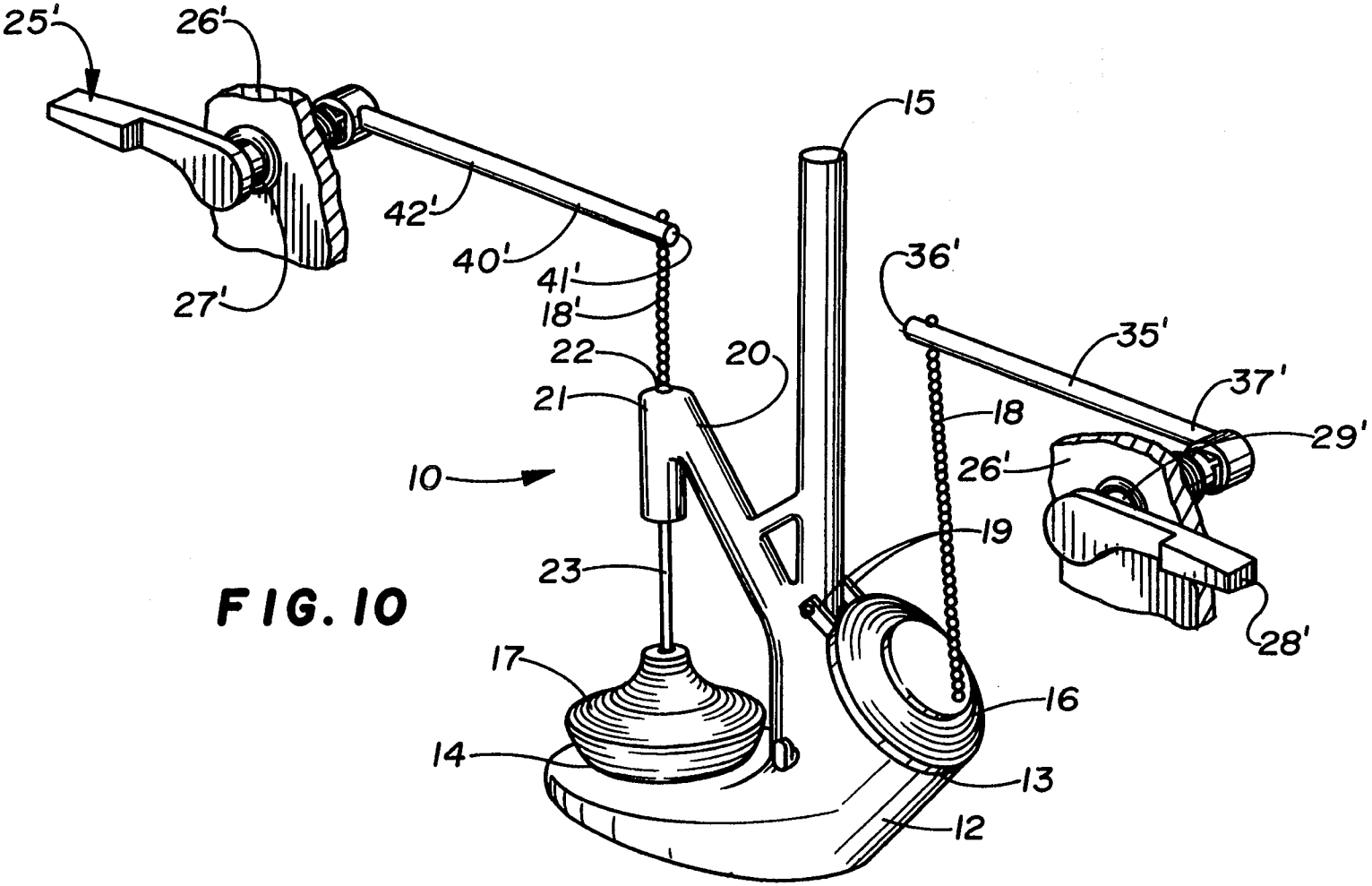
FIG. 10 is a perspective view of the embodiment of FIG. 9 showing the body with the valves seated in the valve ports and the valves connected to the handles.

The present invention can also be adapted to be used with toilets having water storage tanks 11' in which the handles 25', 28' are separated and are disposed on opposite sides of the front wall of the water storage tank 11'. As seen in FIGS. 9–11, a first handle 25' is pivotally mounted on the outside of the wall 26' of the water storage tank 11' as previously described. The first handle 25' has a stem 27' which extends to the inside of the storage tank 11' through a first existing opening in the wall 26'. The first handle 25' is connected to the second end 42' of the second connecting rod 40'. The first end 41' of the second connecting rod 40' is connected to the lower valve 17 as previously described. The second connecting rod 40' need not have a bend nor a break-away means formed thereon as in the previously described embodiment. The second handle 28' is pivotally mounted on the outside of the opposite side of the wall 26' of the water storage tank 11'. A stem 29' of the second handle 28' extends to the inside of the storage tank 11' through a separate existing opening in the wall which is spaced apart from the first existing opening. The stem 29' of the second handle 28' is connected to the second end 37' of the first connecting rod 35'. The first opposite end 36' of the first connecting rod 35' is connected to the upper valve 16 as previously described. The connecting rods 35', 40' may be in the same horizontal plane if desired. The operation of the system is substantially the same as previously described except that the connecting rods 35', 40' are oriented from opposite sides of the storage tank 11' the respective first ends 36', 41' being proximal to one another and the respective second ends 37', 42' being distal from one another. Downward pivotal movement of the first handle 25' pivots the second end 42' of the second connecting rod 40' and elevates the first end 41' of the second connecting rod 40'. The connector 18' is also elevated and the lower valve 17 is unseated from the lower valve port 14 to provide a full flush using a larger regulated amount of water. Downward pivotal movement of the second handle 28' which is separated from and on the opposite side of the wall 26' of the storage tank 11' from the first handle 25', pivots the second end 37' of the first connecting rod 35'. The first end 36' of the second connecting rod 35' is elevated and the connector is also elevated so that the upper valve 16 is unseated from the upper valve port 13. Thus, second handle 28' permits a full flush of the toilet using a smaller regulated amount of water.

Use of the present invention with separated handles also provides the same economical system for conserving water as described in the embodiment having collocated handles.

Obviously, many modifications may be made without departing from the basic spirit of the present invention. Accordingly, it will be appreciated by those skilled in the art that within the scope of the appended claims, the invention may be practiced other than has been specifically described herein.

What is claimed is:

1. A flush valve system for use in a toilet having a water storage tank, the water tank having a bottom, an inside, an outside and a wall therebetween, the flush valve system comprising:

a hollow body mounted inside the tank on the bottom thereof, the body having an upper valve port, a lower valve port and an overflow vent therein;

an upper valve and a lower valve;

means for seating and unseating the upper valve on the upper valve port and means for seating and unseating the lower valve on the lower valve port;

a first connecting rod having a first end and an opposite second end, said first end being connected to the upper valve, a second connecting rod having a first end and an opposite second end, the lower valve being connected to the second connecting rod near the first end of said rod;

a first handle pivotally mounted on the outside of the storage tank, the first handle having a stem extending to the inside of the storage tank through the wall of the tank, the stem of the first handle being connected to the second end of the second connecting rod, whereby when the first handle is pivoted downwardly the first end of the second connecting rod is elevated and the lower value is unseated from the lower valve port such that the toilet is fully flushed using a larger regulated amount of water;

a second collocated handlepivotally mounted on the outside of the storage tank the second handle having a stem extending to the inside of the storage tank through the wall of the tank, said stem being coaxial with the stem of the first handle, the stem of the second handle being connected to the second end of the first connecting rod, whereby when the second handle is pivoted downwardly, the first end of the first connecting rod is elevated and the upper valve is unseated from the upper valve port such that the toilet is fully flushed using a smaller regulated amount of water, further comprising the first connecting rod being disposed in a first horizontal plane, the second connecting rod being disposed in a second and lower horizontal plane, the first end of the second connecting rod having a bend formed therein, the bend extending under the first connecting rod whereby, when the first handle is pivoted downwardly and the first end of the second rod is elevated, the bend on the second connecting rod engages the first connecting rod and elevates the first connecting rod, wherein the lower valve and the upper valve are both unseated and the toilet is fully flushed.

2. The flush valve system of claim 1, further comprising a break away means formed on the second connecting rod near the bend in said rod and between the bend in said rod and the second end of said rod whereby said rod may be broken and the bend in the rod removed such that pivotal movement of the first handle unseats the lower valve only and the first handle and the second handle independently produce unseating of the lower valve and the upper valve respectively.

3. A flush valve system for use in a toilet having a water storage tank, the water storage tank having a bottom, an inside, an outside and a wall therebetween, the flush valve system comprising:

a hollow body mounted inside the tank on the bottom thereof, the body having an upper valve port, a lower valve port and an overflow vent therein;

an upper valve and a lower valve;

means for seating and unseating the upper valve on the upper valve port and means for seating and unseating the lower valve on the lower valve port;

a first connecting rod having a first end and an opposite second end, said first end being connected to the upper valve by a flexible connector, a second connecting rod having a first end and an opposite second end, the lower valve being connected by a flexible connector to the second connecting rod near the first end of said rod;

a first handle pivotally mounted on the outside of the storage tank, the first handle having a stem extending to the inside of the storage tank through the wall of the tank, the stem of the first handle being connected to the second end of the second connecting rod, whereby when the first handle is pivoted downwardly, the first end of the second connecting rod is elevated and the lower valve is unseated from the lower valve port such that the toilet is fully flushed using a larger regulated amount of water;

a second co-located handle pivotally mounted on the outside of the storage tank, the second handle having a stem extending to the inside of the storage tank through the wall of the tank, said stem being coaxial with the stem of the first handle, the stem of the second handle being connected to the second end of the first connecting rod, whereby when the second handle is pivoted downwardly, the first end of the first connecting rod is elevated and the upper valve is unseated from the upper valve port such that the toilet is fully flushed using a smaller regulated amount of water;

the first connecting rod being disposed in a first horizontal plane, the second connecting rod being disposed in a second and lower horizontal plane, the first end of the second connecting rod having a bend formed therein, the bend extending under the first connecting rod whereby, when the first handle is pivoted downwardly and the first end of the second rod is elevated, the bend on the second connecting rod engages the first connecting rod and elevates the first connecting rod, wherein the lower valve and the upper valve are both unseated and the toilet is fully flushed.

4. The flush valve system of claim 3, further comprising a break-away means formed on the second connecting rod near the bend in said rod and between the bend in said rod and the second end of said rod whereby said rod may be broken, and the bend in the rod removed such that pivotal movement of the first handle unseats the lower valve only and the first handle and the second handle independently produce unseating of the lower valve and the upper valve respectively.

5. In a flush valve system for use in a toilet having a water storage tank, the water storage tank having a bottom, an inside, an outside and a wall therebetween, the flush valve system including a hollow body mounted inside the tank on the bottom thereof, the body having an upper valve port, a lower valve port and an overflow vent therein; an upper valve and a lower valve; means for seating and unseating the upper valve on the upper valve port and means for seating and unseating the lower valve on the lower valve port; the improvement therein comprising a first connecting rod having a first end and an opposite second end, said first end being connected to the upper valve, a second connecting rod having a first end and an opposite second end, the lower valve being connected to the second connecting rod near the first end of said rod; a first handle pivotally mounted on the outside of the storage tank, the first handle having a stem extending to the inside of the storage tank through the wall of the tank, the stem of the first handle being connected to the second end of the second connecting rod; a second co-located handle pivotally mounted on the outside of the storage tank, the second handle having a stem extending to the inside of the storage tank through the wall of the tank, said stem being coaxial with the stem of the first handle, the stem of the second handle being connected to the second end of the first connecting rod, whereby when the second handle is pivoted downwardly, the first end of the first connecting rod is elevated and the upper valve is unseated from the upper valve port such that the toilet is flushed using a smaller regulated amount of water, the first end of the second connecting rod having a bend formed therein, the bend extending under the first connecting rod whereby, when the first handle is pivoted downwardly and the first end of the second rod is elevated, the bend on the second connecting rod engages the first connecting rod and elevates the first connecting rod, wherein the lower valve and the upper valve are both elevated and unseated and the toilet is fully flushed using a larger regulated amount of water.

6. In a flush toilet including upper and lower valves having first and second linkages associated therewith, respectively, such that the first linkage opens the upper valve for a partial flushing of the toilet, and such that the second linkage opens the lower valve for a full flushing of the toilet, the improvement comprising a pair of handles including a first handle and a second handle mounted on a common axis for pivotal movement, the first handle being connected to the second linkage, the second handle being connected to the first linkage, such that when the first handle is pivoted, the second linkage opens the lower valve for a full flushing of the toilet, and means responsive to movement of the second linkage to engage and lift the first linkage, such that when the first handle is pivoted, the first and second linkages open the upper and lower valves, respectively for a full and rapid flushing of the toilet, wherein the first and second linkages comprise first and second rods, respectively, and wherein the means responsive to movement of the second linkage to engage and lift the first linkage comprises a bend formed on the second rod and projecting laterally of the second rod being disposed beneath the first rod.

7. In a flush toilet including upper and lower valves having first and second linkages associated therewith, respectively, such that the first linkage opens the upper valve for a partial flushing of the toilet, and such that the second linkage opens the lower valve for a full flushing of the toilet, the improvement comprising a pair of handles including a first handle and a second handle mounted on a common axis for pivotal movement, the first handle being connected to the second linkage, the second handle being connected to the first linkage, such that when the first handle is pivoted, the second linkage opens the lower valve for a full flushing of the toilet, and means responsive to movement of the second linkage to engage and lift the second linkage, such that when the second handle is pivoted, the first and second linkages open the upper and lower valves, respectively, for a full and rapid flushing of the toilet, the first and second linkages comprising first and second rods, respectively, and wherein the means responsive to movement of the second linkage to engage and lift the first linkage comprises a bend formed on the second rod and projecting laterally of the second rod and being disposed beneath the first rod, and wherein the first handle and the second handle each have a length, the length of the first handle being greater than the length of the second handle.

* * * * *